US008519812B2

(12) United States Patent
Kim

(10) Patent No.: US 8,519,812 B2
(45) Date of Patent: Aug. 27, 2013

(54) VACUUM INTERRUPTER FOR VACUUM CIRCUIT BREAKER

(75) Inventor: Byung Chul Kim, Cheongju (KR)

(73) Assignee: LSIS Co., Ltd., Anyang-si (KR)

( * ) Notice: Subject to any disclaimer, the term of this patent is extended or adjusted under 35 U.S.C. 154(b) by 0 days.

(21) Appl. No.: 13/354,267

(22) Filed: Jan. 19, 2012

(65) Prior Publication Data

US 2012/0200376 A1 Aug. 9, 2012

(30) Foreign Application Priority Data

Feb. 8, 2011 (KR) ..... 10-2011-0011255

(51) Int. Cl.
*H01H 9/30* (2006.01)
*H01H 33/66* (2006.01)

(52) U.S. Cl.
USPC ..... 335/201; 218/118

(58) Field of Classification Search
USPC ..... 335/201, 2; 218/118, 127–129, 218/134, 136, 137
See application file for complete search history.

(56) References Cited

U.S. PATENT DOCUMENTS

| | | | | |
|---|---|---|---|---|
| 3,575,656 | A * | 4/1971 | Watrous, Jr. | 324/463 |
| 3,764,764 | A * | 10/1973 | Takasuna et al. | 218/127 |
| 4,672,323 | A * | 6/1987 | Kuhl et al. | 324/460 |
| 2009/0250436 | A1 * | 10/2009 | Matsui et al. | 218/118 |

FOREIGN PATENT DOCUMENTS

| | | |
|---|---|---|
| EP | 1760744 | 3/2007 |
| GB | 1071664 | 6/1967 |
| JP | 48-44309 | 12/1973 |
| JP | 60-44932 | 3/1985 |
| JP | 4-79116 | 3/1992 |
| JP | 2002-304937 | 10/2002 |

OTHER PUBLICATIONS

Jia Shenli et al., "A Kind of Magnetic Shield for Vacuum Interrupters", IEEE 18th International Symposium on Discharges and Electrical Insulation in Vacuum, Aug. 1998, XP-010318454.

* cited by examiner

*Primary Examiner* — Bernard Rojas
(74) *Attorney, Agent, or Firm* — Lee, Hong, Degerman, Kang & Waimey

(57) ABSTRACT

The present invention relates to a vacuum interrupter in a vacuum circuit breaker. According to the present invention, there is provided an attraction member made of a ferromagnetic body for surrounding between the stationary electrode and movable electrode to attract a radial magnetic field generated in a radial direction between the stationary electrode and movable electrode by means of the attraction member, and through this a component of the radial magnetic field may be increased in an overall horizontal direction between the stationary electrode and movable electrode, and as a result the radial magnetic field may be further enhanced between both electrodes, thereby strengthening an arc driving force.

16 Claims, 6 Drawing Sheets

VACUUM INTERRUPTER FOR VACUUM CIRCUIT BREAKER

CROSS-REFERENCE TO RELATED APPLICATIONS

The application claims the benefit of earlier filing date and right of priority to Korean Application No. 10-2011-0011255, filed on Feb. 8, 2011, the contents of is which hereby incorporated by reference herein in its entirety.

BACKGROUND OF THE INVENTION

1. Field of the Invention

The present disclosure relates to a vacuum interrupter for performing an arc extinguishing operation in a vacuum circuit breaker, and more particularly, to a vacuum interrupter of the vacuum circuit breaker for increasing a radial magnetic field having an effect on an arc driving force.

2. Description of the Related Art

In general, a vacuum interrupter in a vacuum circuit breaker is a core extinguishing device applied to a vacuum circuit breaker, a vacuum switch, a vacuum contactor, and the like to interrupt a load current or fault current in a power system. The vacuum circuit breaker, which performs the role of controlling electric power transmission and protecting a power system, has a lot of advantages, such as a large breaking capacity, a high reliability and an enhanced stability, a superior mountability even in a small installation space, and the like, and thus the application area has been expanded to include medium voltages and high voltages. Furthermore, the breaking capacity of the circuit breakers has been also increased in proportion to the increased size of industrial facilities.

The vacuum interrupter in a vacuum circuit breaker operates by using a magnetic field generated by a current flowing through an inherent electrode structure therein at the time of interrupting a fault current. The vacuum interrupter may be largely divided into an axial magnetic field (AMF) type and a radial magnetic field (RMF) type based on the method of generating a magnetic field.

The radial magnetic field type may represent a method of allowing an arc being shrunken by a pinch effect to move while at the same time generating the arc, thereby preventing the damage of the contacts that can occur when a high-temperature arc is constricted between the contacts.

The vacuum interrupter may be advantageous in the aspect of controlling an arc when it has a high arc driving force. The arc driving force may be generated by an interaction between a current density (J) of the current flowing through the arc and a magnetic flux density (B) of the magnetic field generated by a current flowing through the contact shape on its component ($F=J\times B$, where the arc driving force acts in a direction perpendicular to a plane made by two vectors, which are referred to as a current density and a magnetic flux density). Accordingly, the arc driving force can be increased when increasing the current density or magnetic flux density.

FIG. 1 is a longitudinal cross-sectional view illustrating a vacuum interrupter in the related art.

Referring to FIG. 1, in a vacuum interrupter in the related art, an insulated container 1 is sealed by a stationary side seal cap 2 and a movable side seal cap 3, a stationary electrode 4 and a movable electrode 5 are provided to face each other in the insulated container 1 so as to be brought into contact with each other, an inner shield 6 is provided to accommodate a space between the stationary electrode 4 and the movable electrode 5, a stationary shaft 4*a* of the stationary electrode 4 is fixed to and combined with the stationary side seal cap 2 to be connected to the outside thereof, and a movable shaft 5*a* of the movable electrode 5 is slidably combined with the movable side seal cap 3 to be connected to the outside thereof.

Furthermore, a flexible tube shield 7 is fixed to and combined with the movable shaft 5*a* of the movable electrode 5, and a flexible tube 8 is provided between the flexible tube shield 7 and the movable flange 3 in such a manner that the movable electrode 5 and movable shaft 5*a* can be moved in a sealed state within the insulated container 1.

The inner shield 6 is located at a symmetrical position when both electrodes 4, 5 are completely opened, and metal vapor dispersed at the time of generating an arc during the operation of breaking the circuit is adhered thereto, thereby preventing a dielectric strength from being reduced when metal vapor is attached to an inner surface of the insulated container 1.

The foregoing vacuum interrupter in the related art may generate a magnetic field in a radial direction (in a radially emitted direction from the moving direction of the movable electrode) by the stationary electrode 4 and movable electrode 5, and a current flowing through an arc for electrically connecting the two electrodes 4, 5 to each other during the generation of the arc. The magnetic field receives a force due to an interaction with a current flowing from the stationary electrode 4 to the movable electrode 5, and the electrodes are located at the fixed positions, respectively, but the arc moves when receiving the force. Here, the moving direction of the arc should be a direction perpendicular to a plane made by two vectors, which are referred to as a current and a magnetic field, namely, a circumferential direction (i.e., a direction rotated around the shaft) on the basis of a contact point such as an electromagnetic force acting on fluid (a direction perpendicular to the paper surface in the drawing).

However, in the foregoing vacuum interrupter in the related art, part of the arc may not flow in a direction perpendicular to a plane made by a current and a magnetic field (also referred to as "a pure horizontal direction") but flow in the circumference of the pure horizontal direction, namely, an obliquely-diffused direction in the drawing (also referred to as "a non-pure horizontal direction"). The non-pure horizontal direction may be a cause of deteriorating an arc driving force as well as a loss due to a kind of leakage flux compared to a radial magnetic field in the pure horizontal direction contributing to the arc driving force.

SUMMARY OF THE INVENTION

An objective of the present invention is to provide a vacuum interrupter of the vacuum circuit breaker for minimizing an arc in the non-pure horizontal direction, thereby enhancing an arc driving force.

To achieve these and other advantages and in accordance with the purpose of this specification, as embodied and broadly described herein, a vacuum interrupter in a vacuum circuit breaker, the vacuum interrupter comprising: a sealed insulated container; a stationary electrode installed at an inner portion of the insulated container; and a movable electrode disposed to face the stationary electrode and provided to slide against the insulated container to generate a magnetic field between a facing surface of the stationary electrode and a facing surface thereof, wherein an attraction member located adjacent to the facing surfaces of the stationary electrode and movable electrode is provided to attract a radial magnetic field generated between the stationary electrode and movable electrode in a radial direction.

Further scope of applicability of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from the detailed description.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

Hereinafter, a vacuum interrupter in a vacuum circuit breaker according to an embodiment of the present invention will be described in detail with reference to the accompanying drawings.

Figure 1:
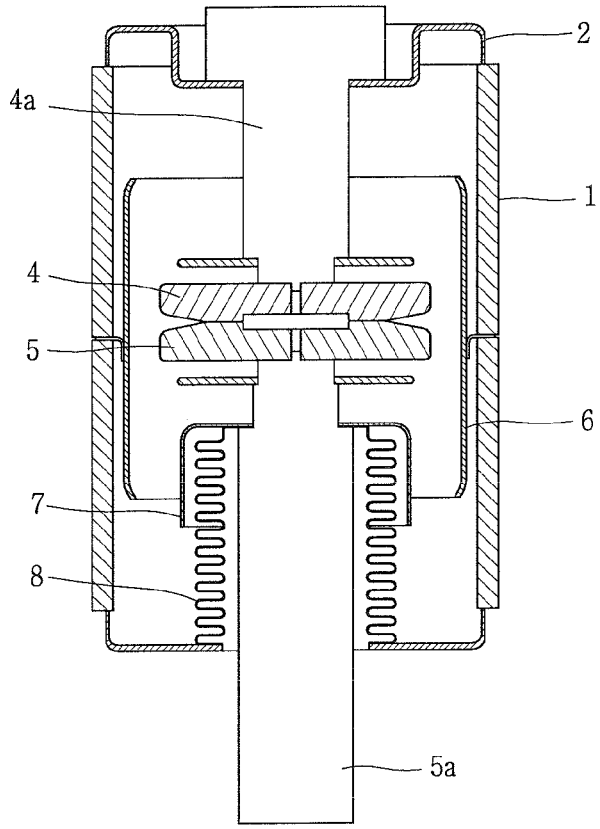
FIG. 1 PRIOR ART
FIG. 1 is a longitudinal cross-sectional view illustrating a typical vacuum interrupter.
Figure 2:
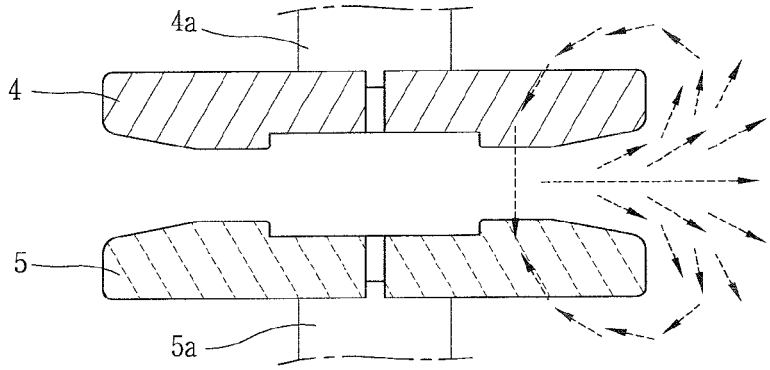
FIG. 2 PRIOR ART
FIG. 2 is a schematic view illustrating a radial magnetic field generated by a current between two electrodes in a vacuum interrupter according to the related art.
Figure 3:
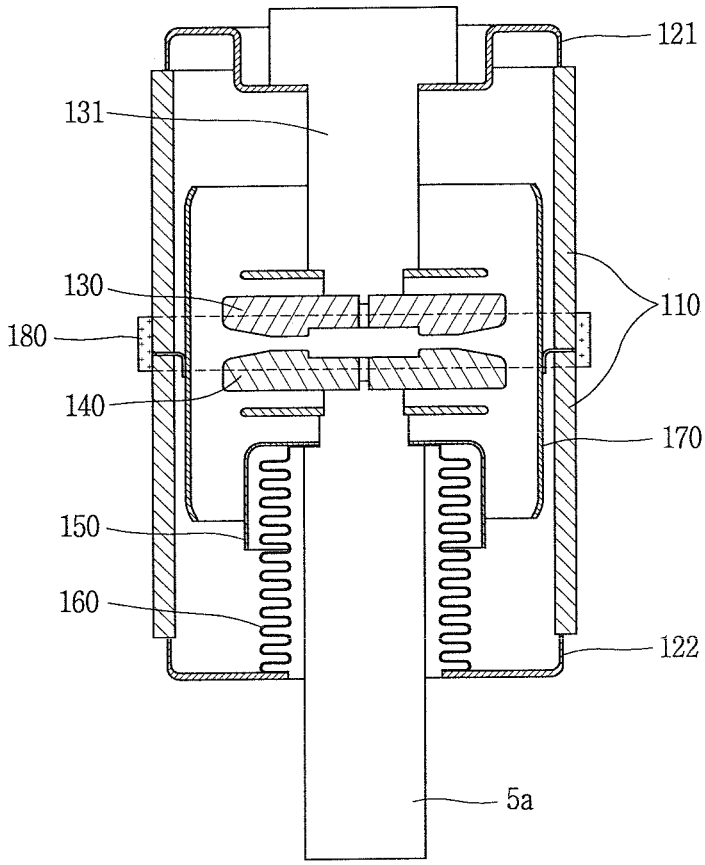
FIG. 3 is a longitudinal cross-sectional view illustrating a vacuum interrupter according to the present invention.

FIG. 3 is a longitudinal cross-sectional view illustrating a vacuum interrupter according to the present invention, and FIGS. 4 through 8 are perspective views and longitudinal cross-sectional views illustrating embodiments in which an attraction member is fixed to a vacuum interrupter according to the present invention.

As described above, a vacuum circuit breaker according to this embodiment may be formed of ceramic and both ends of the insulated container 110 having a cylindrical shape in which both ends thereof are open may be sealed by a stationary side seal cap 121 and a movable side seal cap 122.

A stationary electrode 130 and a movable electrode 140 may be disposed at an inner portion of the insulated container 110 to face each other. The stationary electrode 130 may be fixed thereto through the stationary side seal cap 121 by means of a stationary shaft 131 extended to one surface of the stationary electrode 130, and the movable electrode 140 may be slidably combined therewith through the movable side seal cap 122 by means of a movable shaft 141 extended to one surface of the movable electrode 140.

At least one pair of metal inner shields 170 may be formed in a cylindrical shape inside the insulated container 110 to accommodate the stationary electrode 130 and movable electrode 140 and fixed and combined with an inner circumferential surface of the insulated container 110.

An attraction member 180 may be fixed and combined with an outer circumferential surface of the insulated container 110 to attract a radial magnetic field generated between the stationary electrode 130 and movable electrode 140 in a horizontal direction.

The attraction member 180 may be formed of a ferromagnetic body made of ferrite, cobalt, nickel, their alloy, or the like to be adhered and fixed to an outer circumferential surface of the insulated container 110.

Furthermore, the attraction member 180 may be preferably formed with a height in the width direction (in a moving direction of the movable electrode, which is hereinafter abbreviated as an axial direction) such that the height is formed substantially not less than a maximum distance between the 130 and movable electrode 140, thereby enhancing an attraction force.

Furthermore, the attraction member 180 may be formed in a circular shape and fixed to the insulated container 110, or a plurality of the attraction members 180 may be formed in an arc shape and fixed to the insulated container 110.

Figure 4:
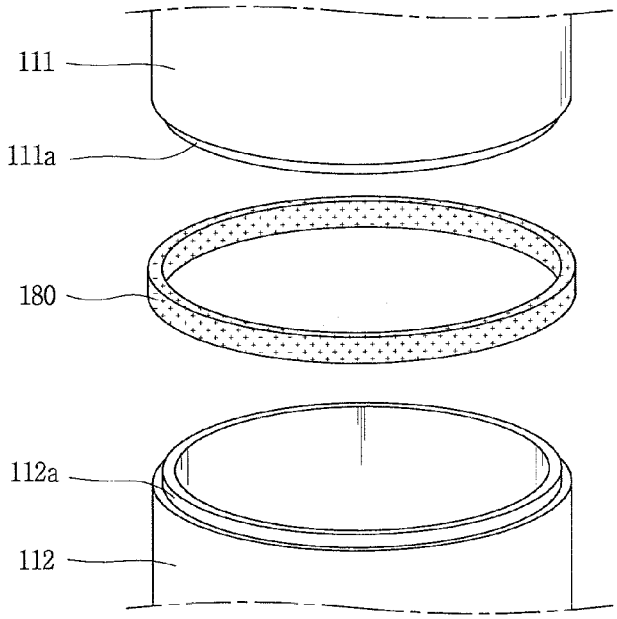
FIGS. 4 through 8 are perspective views and longitudinal cross-sectional views illustrating embodiments in which an attraction member is fixed to a vacuum interrupter according to the present invention.
Figure 5:
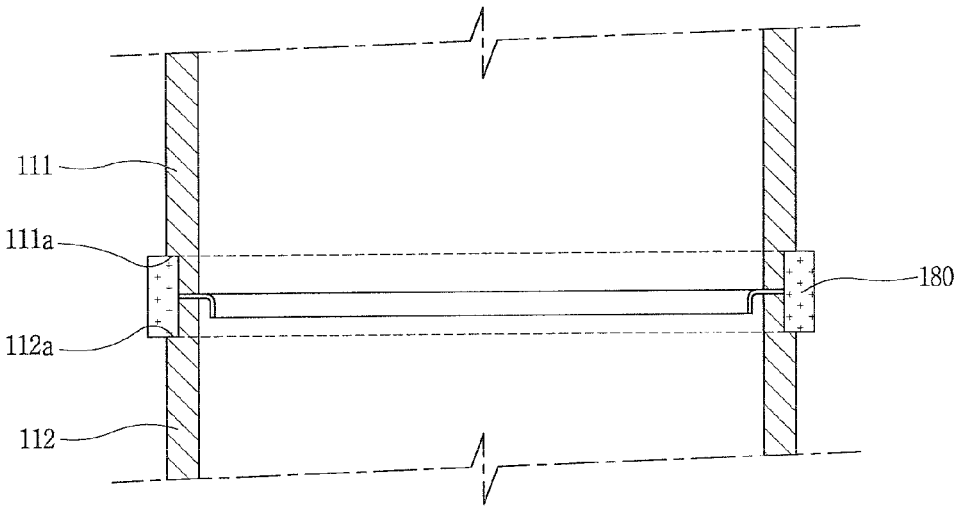
Figure 6:
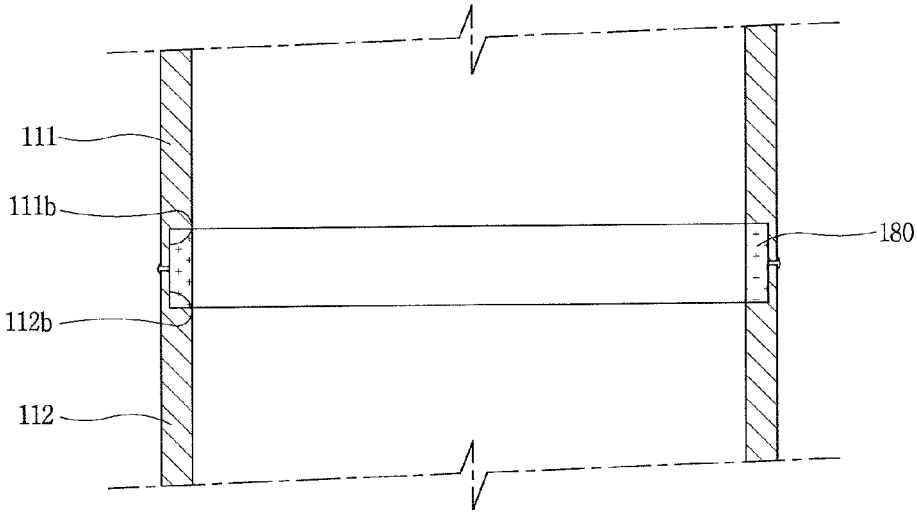

For example, in case where the attraction member 180 is a circular shape, the insulated container 110 may be divided into a first insulated container 111 and a second insulated container 112 as illustrated in FIGS. 4 through 6, and support grooves 111*a*, 112*a*, 111*b*, 112*b* for inserting the attraction member 180 may be formed in a stepped manner at an outer circumferential side edge (refer to FIGS. 4 and 5) or an inner circumferential surface (refer to FIG. 6) of the first insulated container 111 and second insulated container 112, and the attraction member 180 may be inserted into the support grooves 111*a*, 112*a*, 111*b*, 112*b* of the first insulated container 111 and second insulated container 112 to weld and combine the first insulated container 111 and second insulated container 112 with each other, thereby allowing the attraction member 180 to be supported by the insulated container 110 in a horizontal direction. Of course, support protrusions (not shown) instead of the support grooves 111*a*, 112*a* may be formed at an outer circumferential surface of the first insulated container 111 and second insulated container 112 to support the attraction member 180 in an axial direction.

Figure 7:
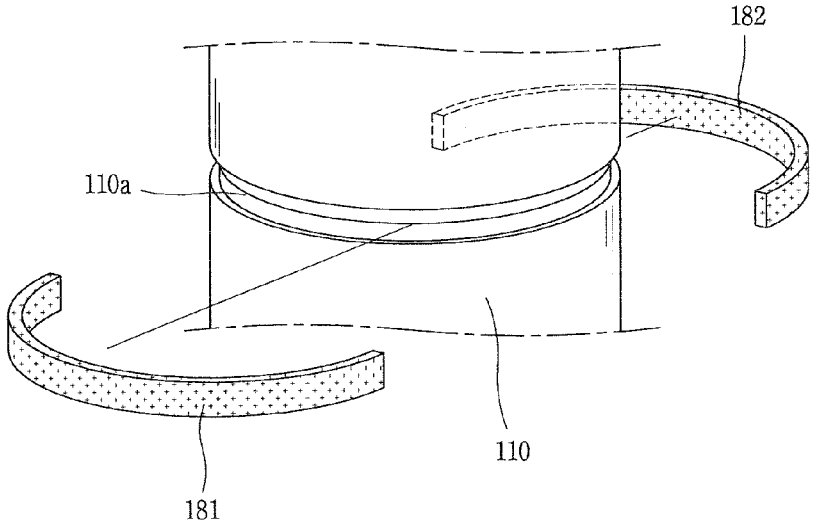

On the contrary, in case where the attraction member 180 is an arc shape, a support groove 110*a* may be formed with a predetermined depth or a plurality of support protrusions (not shown) having a predetermined height may be formed at an outer circumferential surface of the insulated container 110 as illustrated in FIG. 7, and the plurality of attraction members 181, 182 may be welded or combined with each other using another method in a state that the plurality of attraction members 181, 182 are inserted between the support grooves 110*a* or support protrusions to fix the attraction members 181, 182 to the insulated container 110.

Figure 8:
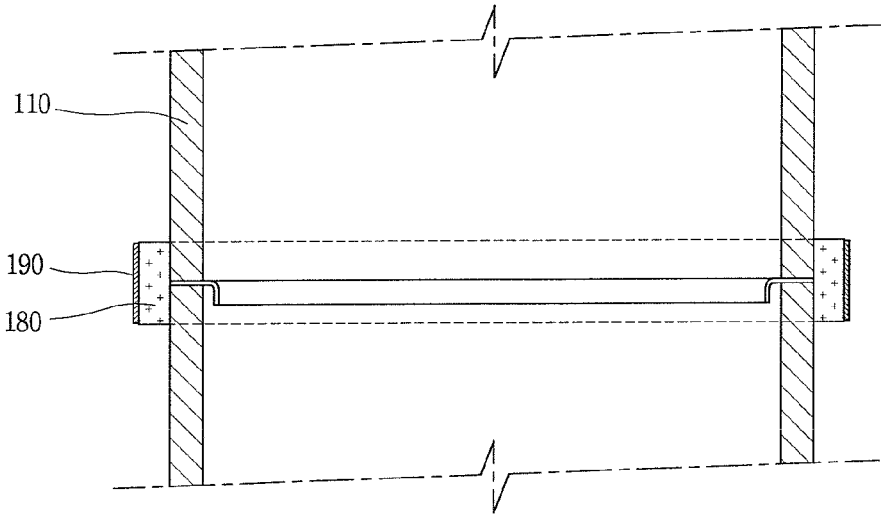
Figure 9:
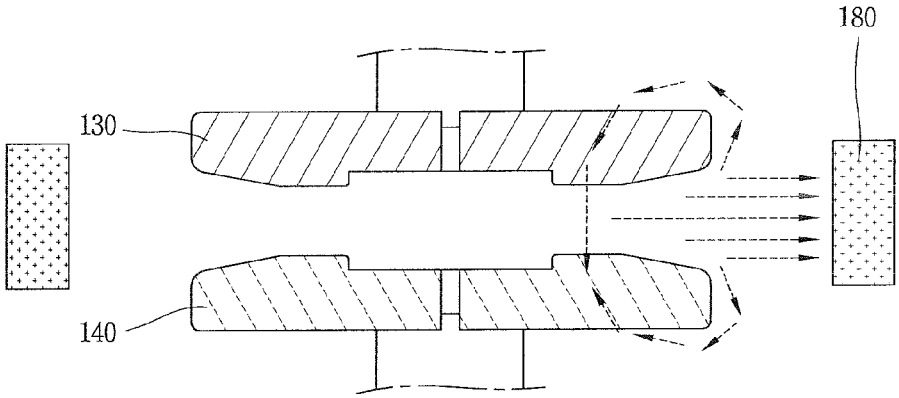
FIG. 9 is a schematic view illustrating a radial magnetic field generated by a current between two electrodes in a vacuum interrupter according to the present invention.

On the other hand, in case where the attraction members are provided at an outer circumferential surface of the insulated container as illustrated in FIG. 8, they may be combined with each other using a separate member such as a fixing ring 190 regardless whether the attraction member is a circular or arc shape.

The foregoing vacuum interrupter in a vacuum circuit breaker according to the present invention may have the following working effect.

In other words, in case where the attraction member 180 made of a ferromagnetic body is provided at an outer circumferential surface of the insulated container 110, if the attraction member 180 surrounds an outer circumferential surface of the insulated container 110, more particularly, between the stationary electrode 130 and movable electrode 140, then a radial magnetic field generated between the stationary electrode 130 and movable electrode 140 in a radial direction may be attracted to the attraction member 180.

Then, a radial magnetic field in a pure horizontal direction as well as part of the radial magnetic field in a non-pure horizontal direction, among the radial magnetic fields generated between the stationary electrode 130 and movable electrode 140, may be attracted by the attraction member 180 to enhance a component of the radial magnetic field in an overall horizontal direction, and thorough this, the radial magnetic field between both electrodes 130, 140 may be further increased ultimately, thereby enhancing an arc driving force.

A vacuum interrupter in a vacuum circuit breaker according to another embodiment of the present invention will be described as follows.

In other words, the attraction member 180 may be fixed to an outer circumferential surface of the insulated container 110, but according to circumstances, the attraction member 180 may be provided at an outer circumferential surface of the insulated container 110 with regular intervals or the attraction member 180 may be provided at an inner portion of the insulated container 110.

Figure 10:
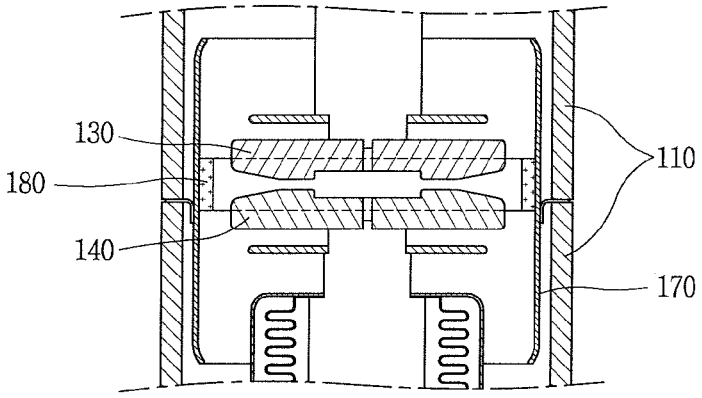
FIGS. 10 and 11 are longitudinal cross-sectional views illustrating other embodiments in which an attraction member is fixed to a vacuum interrupter according to the present invention.
Figure 11:
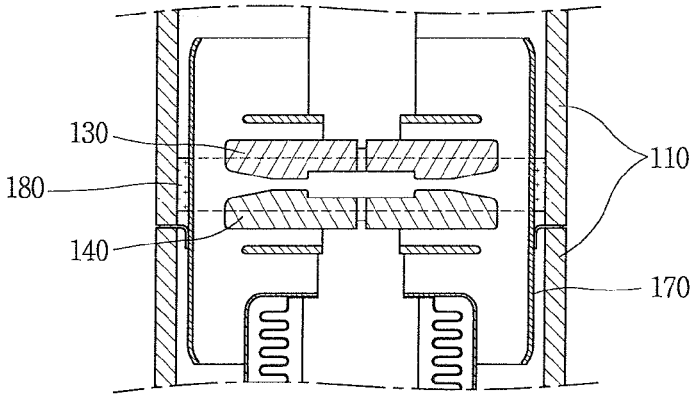

Here, in case where the attraction member 180 is provided at an inner portion of the insulated container, the attraction member 180 may be fixed and combined with an inner circumferential surface of the inner shield 170 as illustrated in FIG. 10 or may be provided between an outer circumferential surface of the 170 and an inner circumferential surface of the insulated container 110 as illustrated in FIG. 11. Furthermore, the inner shield 170 may be formed of a ferromagnetic body, thereby allowing the inner shield 170 to perform the role of the attraction member at the same time.

The basic configuration and its working effect of a vacuum interrupter in a vacuum circuit breaker according to this embodiment may be substantially the same as the foregoing embodiment. However, in case where the attraction member is provided at an inner portion of the insulated container as illustrated in this embodiment, the insulated container should be increased as much as a volume required for providing the attraction member, and thus it may be relatively increased compared to the foregoing embodiment in the aspect of the size. However, as the attraction member is provided at an inner portion of the insulated container, an overall appearance of the vacuum interrupter may be formed in a sleek design, and an interference between the vacuum interrupter and other components due to the attraction member may be prevented in advance. In particular, in case where the inner shield is used as an attraction member, the number of assembly parts may be decreased without increasing the size of the vacuum interrupter, thereby reducing the fabrication cost.

As described above, according to a vacuum interrupter in a vacuum circuit breaker in accordance with this embodiment, there is provided an attraction member made of a ferromagnetic body for surrounding between the stationary electrode and movable electrode to attract a radial magnetic field generated in a radial direction between the stationary electrode and movable electrode by means of the attraction member. Through this, a component of the radial magnetic field may be increased in an overall horizontal direction between the stationary electrode and movable electrode, and as a result the radial magnetic field may be further enhanced between both electrodes, thereby strengthening an arc driving force.

What is claimed is:

1. A vacuum interrupter in a vacuum circuit breaker, the vacuum interrupter comprising:

a sealed insulated container;

a stationary electrode located at an inner portion of the insulated container;

a movable electrode facing the stationary electrode and configured to slide against the insulated container in order to generate a magnetic field between a facing surface of the stationary electrode and a facing surface of the movable electrode; and an attraction member permanently fixed to an outer circumferential surface of the insulated container adjacent to the facing surface of the stationary electrode and the facing surface of the movable electrode and configured to attract a radial magnetic field generated between the stationary electrode and movable electrode in a radial direction; and a support portion formed in a stepped manner on the outer circumferential surface of the insulated container in order to support the attraction member inserted into the support portion in an axial direction, wherein the axial direction is a moving direction of the movable electrode.

2. The vacuum interrupter of claim 1, wherein the attraction member is formed in a ring shape.

3. The vacuum interrupter of claim 1, wherein the attraction member is formed of a plurality of arc shapes, and the plurality of arc-shaped attraction members are combined with one another to form a ring shape.

4. The vacuum interrupter of claim 1, wherein the attraction member is disposed on an inner portion of the insulated container.

5. The vacuum interrupter of claim 4, wherein the insulated container is formed with a first container and a second container, and a first support portion and a second support portion are formed at the corresponding ends of the first container and second container to support the attraction member in an axial direction.

6. The vacuum interrupter of claim 5, wherein the attraction member is inserted between the first support portion and second support portion, and the first container and second container are combined to fix the attraction member.

7. The vacuum interrupter of claim 1, further comprising an inner shield provided inside the insulated container in order to accommodate the stationary electrode and movable electrode.

8. The vacuum interrupter of claim 7, wherein the attraction member is provided at an inner circumferential surface of the inner shield.

9. The vacuum interrupter of claim 7, wherein the attraction member is provided at an outer circumferential surface of the inner shield.

10. The vacuum interrupter of claim 1, wherein a height of the attraction member in an axial direction is not less than a maximum distance between the stationary electrode and movable electrode.

11. The vacuum interrupter of claim 1, wherein the attraction member comprises a ferromagnetic body.

12. A vacuum interrupter in a vacuum circuit breaker, the vacuum interrupter comprising:

a sealed insulated container;

a stationary electrode located at an inner portion of the insulated container;

a movable electrode facing the stationary electrode and configured to slide against the insulated container in order to generate a magnetic field between a facing surface of the stationary electrode and a facing surface of the movable electrode; and an attraction member permanently fixed to an outer circumferential surface of the insulated container adjacent to the facing surface of the stationary electrode and the facing surface of the movable electrode and configured to attract a radial magnetic field generated between the stationary electrode and movable electrode in a radial direction, wherein the attraction member is formed in a ring shape, wherein the insulated container comprises a first container and a second container, and wherein a first support groove and a second support groove are formed in a stepped manner at corresponding ends of the first container and second container in order to support the attraction member inserted into the first support groove and second support groove in an axial direction.

13. The vacuum interrupter of claim 12, wherein:

the attraction member is inserted between the first support groove and second support groove; and the first container and second container are combined to attach the attraction member.

14. The vacuum interrupter of claim 12, further comprising an inner shield provided inside the insulated container in order to accommodate the stationary electrode and movable electrode.

15. The vacuum interrupter of claim 12, wherein a height of the attraction member in an axial direction is not less than a maximum distance between the stationary electrode and movable electrode.

16. The vacuum interrupter of claim 12, wherein the attraction member comprises a ferromagnetic body.

* * * * *